US011462856B2

(12) United States Patent
Phillips et al.

(10) Patent No.: US 11,462,856 B2
(45) Date of Patent: Oct. 4, 2022

(54) PLUG CONNECTOR HAVING A LATCH RETENTION ASSIST MEMBER

(71) Applicant: TE Connectivity Services GmbH, Schaffhausen (CH)

(72) Inventors: Michael John Phillips, Camp Hill, PA (US); Christopher David Ritter, Hummelstown, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 0 days.

(21) Appl. No.: 17/123,534

(22) Filed: Dec. 16, 2020

(65) Prior Publication Data

US 2022/0190516 A1 Jun. 16, 2022

(51) Int. Cl.

| | |
|---|---|
| ***H01R 13/62*** | (2006.01) |
| ***H01R 13/627*** | (2006.01) |
| ***H01R 12/70*** | (2011.01) |
| ***H01R 13/633*** | (2006.01) |

(52) U.S. Cl.
CPC ..... *H01R 13/6275* (2013.01); *H01R 12/7005* (2013.01); *H01R 13/6335* (2013.01)

(58) Field of Classification Search
CPC ..... H01R 13/6275; H01R 12/7005; H01R 13/6335
See application file for complete search history.

(56) References Cited

U.S. PATENT DOCUMENTS

| | | | | |
|---|---|---|---|---|
| 8,231,400 | B2 | 7/2012 | Phillips et al. | |
| 8,449,314 | B1 * | 5/2013 | Feist | H01R 13/512 439/358 |
| 10,263,349 | B2 | 4/2019 | Phillips et al. | |
| 10,276,976 | B1 | 4/2019 | Phillips et al. | |
| 10,320,100 | B2 | 7/2019 | Phillips | |
| 10,454,203 | B2 | 10/2019 | Phillips et al. | |
| 10,547,142 | B1 | 1/2020 | Henry et al. | |
| 10,680,363 | B2 | 6/2020 | Phillips et al. | |
| 2011/0294333 | A1 * | 12/2011 | Wu | H01R 13/6335 439/345 |
| 2011/0294334 | A1 * | 12/2011 | Phillips | G02B 6/4201 439/357 |
| 2012/0058665 | A1 * | 3/2012 | Zerebilov | H01R 13/6275 439/345 |
| 2012/0129382 | A1 * | 5/2012 | Regnier | H01R 4/2429 439/421 |
| 2014/0141641 | A1 * | 5/2014 | De Dios Martin | H01R 43/26 439/358 |

* cited by examiner

*Primary Examiner* — Truc T Nguyen

(57) ABSTRACT

A plug connector includes a housing holding plug contacts at a mating end for mating with a mating connector. The plug connector includes a latch received in a latch pocket and movable between a latched position and an unlatched position. The latch has a main body and a latch beam extending from the main body. The latch beam includes a latch hook configured to be received in a latch opening of the mating connector in the latched position to secure the plug connector to the mating connector. The plug connector includes a retention assist member engaging the latch having a main body and a ram extending therefrom with a latch retention support positioned rearward of the latch beam. A biasing member drives the retention assist member in a biasing direction into the latch to hold the latch hook in the latching position.

20 Claims, 4 Drawing Sheets

PLUG CONNECTOR HAVING A LATCH RETENTION ASSIST MEMBER

BACKGROUND OF THE INVENTION

The subject matter herein relates generally to plug connectors.

Electrical connectors provide communicative interfaces between electrical components to transmit power and/or signals therethrough. For example, the electrical connectors may be used within telecommunication equipment, servers, and data storage or transport devices. When two electrical connectors are mated together during operation, one or both of the connectors may experience twisting forces or axial forces that pull the connectors away from each other. Typical electrical connectors include latching mechanisms configured to maintain the two connectors in the mated position to retain the communicative pathway through the connectors.

However, known latching mechanisms are not without disadvantages. For instance, some known latch designs have low connector to plug retention strength. The latches are subject to failure or breaking due to excessive force applied to the latch. The latches may become inadvertently unlatched, such as when the cable of the receptacle connector is pulled rearward, overcoming the retention force of the latch. Some known latches utilize a return spring to provide a return force to return the latch to a latched position and resist unintentional de-latching. However, with some known connectors, the return force may be high, leading to users encountering difficulties in overcoming the spring force to release the latch. Additionally, with latches that utilize a pull tab to actuate the latch, pulling rearward on the latch tends to pull the hook rearward against the corresponding latching component, causing the latch to bind against the latching component and thus increasing the de-latching force needed to move the latch to the released position.

A need remains for a cost effective and reliable latching system for a plug connector.

BRIEF DESCRIPTION OF THE INVENTION

In an embodiment, a plug connector is provided. The plug connector includes a housing having a front and a rear. The housing has a first end and a second end opposite the first end extending between the front and the rear. The housing has a first side and a second side opposite the first side extending between the front and the rear. The housing has a mating end at the front for mating with a mating connector. The housing has a latch pocket at the first end. The plug connector includes plug contacts held by the housing. The plug contacts are provided proximate to the mating end for mating with the mating connector. The plug connector includes a latch received in the latch pocket and movable between a latched position and an unlatched position. The latch has a main body and a latch beam extending from the main body. The latch beam includes a latch hook configured to be received in a latch opening of the mating connector in the latched position to secure the plug connector to the mating connector. The plug connector includes a retention assist member received in the latch pocket and configured to engage the latch. The retention assist member includes a main body and a ram extending from the main body. The ram includes a latch retention support positioned rearward of the latch beam. The retention assist member includes a biasing member engaging the retention assist member to drive the retention assist member in a forward biasing direction. The latch retention support is driven into the latch to hold the latch hook in the latching position.

In another embodiment, a plug connector is provided. The plug connector includes a housing having a front and a rear. The housing has a first end and a second end opposite the first end extending between the front and the rear. The housing has a first side and a second side opposite the first side extending between the front and the rear. The housing has a mating end at the front for mating with a mating connector. The housing has a latch pocket at the first end. The plug connector includes plug contacts held by the housing. The plug contacts are provided proximate to the mating end for mating with the mating connector. The plug connector includes a latch received in the latch pocket and being rotatable between a latched position and an unlatched position. The latch has a main body and a latch beam extending from the main body. The latch beam includes a latch hook configured to be received in a latch opening of the mating connector in the latched position to secure the plug connector to the mating connector. The plug connector includes a retention assist member received in the latch pocket and configured to engage the latch. The retention assist member includes a main body and a ram extending from the main body. The ram includes a latch retention support positioned rearward of the latch beam. The retention assist member is slidable relative to the housing between an extended position and a retracted position. The retention assist member includes a biasing member engaging the retention assist member to drive the retention assist member in a forward biasing direction to the extended position. The latch is configured to move to the unlatched position when the retention assist member is in the retracted position. The latch retention support is driven into the latch to move the latch to the latched position when the retention assist member is moved to the extended position.

In a further embodiment, a plug connector is provided. The plug connector includes a housing having a front and a rear. The housing has a first end and a second end opposite the first end extending between the front and the rear. The housing has a first side and a second side opposite the first side extending between the front and the rear. The housing has a mating end at the front for mating with a mating connector. The housing has a latch pocket at the first end. The plug connector includes plug contacts held by the housing. The plug contacts are provided proximate to the mating end for mating with the mating connector. The plug connector includes a latch received in the latch pocket and movable between a latched position and an unlatched position. The latch has a main body and a latch beam extending from the main body. The latch beam includes a rail at a proximal end extending from the main body. The latch beam includes a ramp extending from the rail. The latch beam includes a latch hook at a distal end configured to be received in a latch opening of the mating connector in the latched position to secure the plug connector to the mating connector. The plug connector includes a retention assist member received in the latch pocket and configured to engage the latch. The retention assist member includes a main body and a ram extending from the main body. The ram includes a latch retention support positioned rearward of the latch beam. The retention assist member includes a biasing member engaging the retention assist member to drive the retention assist member in a forward biasing direction. The latch retention support engages the ramp of the latch beam to drive the latch to the latching position.

DETAILED DESCRIPTION OF THE INVENTION

Figure 1:
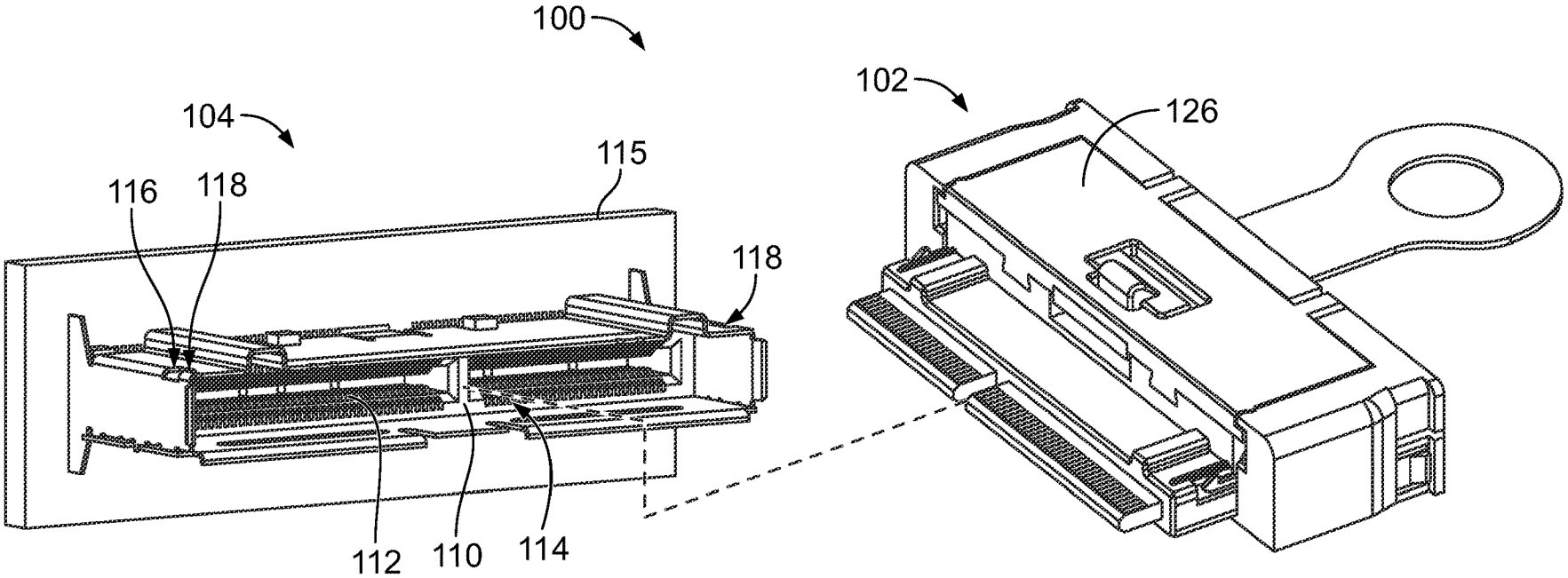
FIG. 1 illustrates a connector system formed in accordance with an exemplary embodiment.

FIG. 1 illustrates a connector system 100 formed in accordance with an exemplary embodiment. The connector system 100 includes a plug connector 102 and a receptacle connector 104. The plug connector 102 is configured to be mated with the receptacle connector 104 at a separable mating interface. The receptacle connector 104 defines a mating connector for the plug connector 102.

The receptacle connector 104 includes a housing 110 holding receptacle contacts 112 configured to be mated with the plug connector 102. The receptacle contacts 112 may be arranged within a cavity 114 that receives a portion of the plug connector 102. The housing 110 and the receptacle contacts 112 may be terminated to a circuit board 115. For example, the receptacle contacts 112 may be press fit in vias in the circuit board 115 or soldered to surface pads of the circuit board 115. In other various embodiments, the receptacle connector 104 may be a cable connector terminated to an end of a cable with the receptacle contacts 112 terminated to wires of the cable. In various embodiments, the receptacle connector 104 may have a card slot (not shown) at a front of the housing 110 configured to receive a circuit card of the plug connector 102. The receptacle contacts 112 may include spring beam contacts configured to be mated with the circuit card. However, the receptacle contacts 112 may be other types of contacts in alternative embodiments, such as contact pads, pins, sockets, and the like. In other various embodiments, the housing 110 of the receptacle connector 104 may hold a circuit card configured to be mated with the plug connector 102. For example, the receptacle contacts 112 may be contact pads on the circuit card.

The receptacle connector 104 includes latching features 116 for latchably securing the plug connector 102 to the receptacle connector 104. In the illustrated embodiment, the latching features 116 include latch openings 118 in the housing 110 configured to receive complementary latching features of the plug connector 102. The latch openings 118 are defined by walls surrounding the latch openings 118. In the illustrated embodiment, the latch openings 118 are provided in the housing 110, such as in the top wall of the housing 110. For example, the top wall of the housing 110 may be a metal sheet or plate with the latch opening 118 stamped or cut into the top wall. The latch openings 118 may be provided at other locations in alternative embodiments. In an exemplary embodiment, a portion of the plug connector 102 is loaded into the cavity of the housing 110 to interface with the latching features 116 from inside the housing 110.

Figure 2:
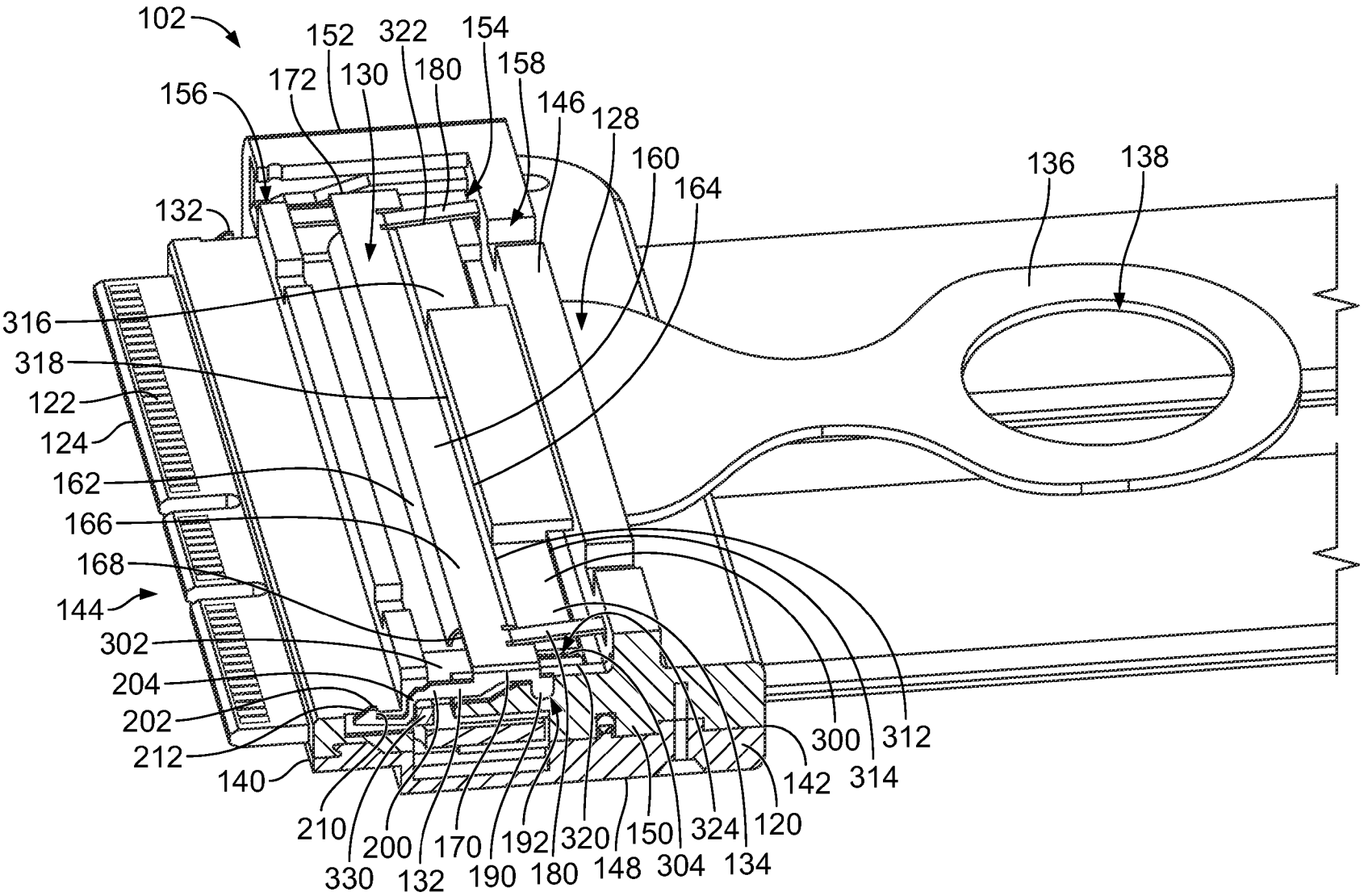
FIG. 2 is a side perspective, partial sectional view of the plug connector in accordance with an exemplary embodiment.

FIG. 2 is a side perspective, partial sectional view of the plug connector 102 in accordance with an exemplary embodiment. The plug connector 102 includes a housing 120 holding plug contacts 122 configured to be mated with corresponding receptacle contacts 112 of the receptacle connector 104 (both shown in FIG. 1). In the illustrated embodiment, the receptacle connector 104 includes a circuit card 124 configured to be plugged into the card slot of the receptacle connector 104. The plug contacts 122 are contact pads at a card edge of the circuit card 124. However, the plug contacts 122 may be other types of contacts in alternative embodiments, such as spring beams. In other various embodiments, the housing 120 of the plug connector 102 may include a card slot configured to receive a circuit card of the receptacle connector 104 and the housing 120 may hold discrete plug contacts 122, such as spring beam contacts, for mating to the circuit card or other types of mating contacts.

The plug connector 102 includes a cover 126 (shown in FIG. 1) configured to be coupled to the housing 120. The cover 126 closes the housing 120, such as at the top of the housing 120. In various embodiments, the cover 126 may be clipped to the housing 120. In other various embodiments, the cover 126 may be secured to the housing 120 using fasteners or other securing features. The cover 126 may be used to secure the circuit card 124 in the housing 120. The cover 126 may be used to secure an actuator 128 in the housing 120. The cover 126 may be used to secure a latch 130 in the housing 120. The actuator 128 is used to unlatch the latch 130.

In an exemplary embodiment, the plug connector 102 may include cables extending from the rear of the housing 120. The cables are electrically connected to corresponding plug contacts 122. For example, the cables may be terminated to the circuit card 124, such as by soldering.

The plug connector 102 includes the latch 130 for latchably securing the plug connector 102 to the receptacle connector 104. The latch 130 is coupled to the housing 120. The latch 130 may be secured in the housing 120 using the cover 126. For example, the cover 126 may cover a portion of the latch 130. In the illustrated embodiment, the latch 130 includes latch beams 132 configured to be received in the latch openings 118 (FIG. 1) of the receptacle connector 104.

The plug connector 102 includes an actuator 128 operably coupled to the latch 130 for actuating the latch 130 to move the latch beams 132 between latched positions and released positions, such as to release the plug connector 102 from the receptacle connector 104. The actuator 128 may be coupled to the housing 120 and/or the cover 126. In an exemplary embodiment, the actuator 128 includes a retention assist member 134 configured to engage the latch 130 to urge the latch 130 to the latched position. In an exemplary embodiment, the actuator 128 includes a pull tab 136 extending from the retention assist member 134. The pull tab 136 includes a finger grip 138 for pulling the pull tab 136 and the retention assist member 134 rearward for actuating the latch 130. However, in other various embodiments, the actuator 128 may include other types of actuating features. In an exemplary embodiment, pulling the actuator 128 rearward releases the latch 130 to allow the latch to move to the released position. The latch 130 may be rotated from the latched position to the released position to unload the latch 130 from the receptacle connector 104. Such releasing of the latch 130 eliminates the risk of binding of the latch 130 against the receptacle connector 104, thus reducing the releasing force of the latch 130.

The housing 120 of the plug connector 102 includes a front 140 and a rear 142. In an exemplary embodiment, the housing 120 has a mating end 144 at the front 140 for mating with the mating connector defined by the receptacle connector 104. The plug contacts 122 may be located proximate to the front 140 for mating with the receptacle connector 104.

The housing 120 includes a first end 146 and a second end 148 opposite the first end 146. The first and second ends 146, 148 extend between the front 140 and the rear 142. In various orientations, the first end 146 may be a top end and the second end 148 may be a bottom end; however, other orientations are possible in alternative embodiments. The latch 130 and the retention assist member 134 may be provided at the first end 146.

The housing 120 includes a first side 150 and a second side 152 opposite the first side 150. The first and second sides 150, 152 extend between the front 140 and the rear 142. The first and second sides 150, 152 extend between the first end 146 and the second end 148. In various embodiments, the housing 120 may be generally rectangular shaped; however, other shapes are possible in alternative embodiments.

In an exemplary embodiment, the housing 120 has a latch pocket 154 at the first end 146. The latch pocket 154 may be located proximate to the rear 142. The latch 130 and the retention assist member 134 are received in the latch pocket 154. The latch pocket 154 includes latch channels 156 that receive corresponding latch beams 132 when the latch 130 is in the latch pocket 154. Optionally, at least a portion of the cover 126 (shown in FIG. 1) is received in the latch pocket 154 to secure the latch 130 in the latch pocket 154. In an exemplary embodiment, the housing 120 includes securing features 158 for securing the cover 126 to the housing 120. For example, the securing features 158 may be heat stakes, interference posts, crush ribs, fasteners, and the like.

The latch 130 includes a main body 160 extending between the latch beams 132. In an exemplary embodiment, the latch 130 is a stamped and formed component with the main body 160 and the latch beams 132 being integral with each other and being stamped and formed from a common sheet of metal. Alternatively, the main body 160 may be separately formed from the latch beams 132 and coupled thereto, such as being welded or fastened to the latch beams 132. The main body 160 includes a front 162 and a rear 164. The main body 160 includes a first end 166 and a second end 168 opposite the first end 166. The first and second ends 166, 168 extend between the front 162 and the rear 164. In various orientations, the first end 166 may be a top end and the second end 168 may be a bottom end; however, other orientations are possible in alternative embodiments. The main body 160 includes a first side 170 and a second side 172 opposite the first side 170. The first and second sides 170, 172 extend between the front 162 and the rear 164.

The latch 130 includes return springs 180 extending from the main body 160. In the illustrated embodiment, the return springs 180 extend from the rear 164 of the main body 160. The return springs 180 are coupled to the housing 120. In an exemplary embodiment, the return springs 180 are provided proximate to the first side 170 and the second side 172. The return springs 180 bias the latch 130 toward the released or unlatched position. For example, the return springs 180 may force the latch 130 downward. The return springs 180 may be formed or bent to preload the return springs 180 with an internal spring bias such that the return springs 180 impart a downward biasing force on the latch 130, such as in the unlatching direction. In the illustrated embodiment, two return springs 180 are provided, such as proximate to the first and second sides 170, 172; however, greater or fewer return springs 180 may be provided in alternative embodiments. In alternative embodiments, the latch 130 may be provided without the return springs 180.

The latch 130 includes one or more pivot elements 190. The latch 130 pivots at the pivot elements 190 between the latched position and the unlatched position. In the illustrated embodiment, the pivot elements 190 include pivot tabs. The pivot tabs are located at the first and second sides 170, 172 of the main body 160. The pivot tabs may be aligned with the latch beams 132. In the illustrated embodiment, the pivot elements 190 extend from the second end 168 (for example, the bottom) to engage the housing 120. For example, the pivot elements 190 may be received in pockets 192 in the housing 120. The pivot element 190 has a rounded pivot surface. In alternative embodiments, the pivot element 190 may be a rod or axle extending across the latch 130, such as between the first and second sides 170, 172.

In an exemplary embodiment, each latch beam 132 includes a rail 200 and a latch hook 202 at a distal end of the latch beam 132. The latch beam 132 may be stamped and formed with the main body 160. In the illustrated embodiment, the latch beam 132 is bent, such as at 90°, from the main body 160, such that the latch beam 132 is oriented in a plane that is generally perpendicular to the plane of the main body 160 (for example, vertical plane versus horizontal plane). The rail 200 extends forward from the main body 160 of the latch 130. In an exemplary embodiment, the latch beam 132 includes a ramp 204 between the rail 200 and the latch hook 202. In the illustrated embodiment, the rail 200 extends between the main body 160 and the ramp 204 and the ramp 204 extends between the rail 200 and the latch hook 202. The ramp 204 extends generally forward and downward from the rail 200. The latch hook 202 extends generally forward and upward from the ramp 204. The latch beam 132 may have other shapes in alternative embodiments. The latch beam 132 may have other parts or sections in alternative embodiments. Optionally, the rail 200 may be planar and define a latch plane for the latch 130. The latch plane may be a vertical latch plane. In an exemplary embodiment, the pivot element 190 extends from the rail 200. For example, the pivot element 190 may be provided at a rear end of the rail 200.

The latch hook 202 is provided at the latching end. The latch hook 202 is configured to be received in the corresponding latch opening 118 of the receptacle connector 104 (both shown in FIG. 1). The latch hook 202 is provided at a distal end of the latch beam 132. In an exemplary embodiment, the latch hook 202 includes a rear ramp wall 210 and a front ramp wall 212. In the illustrated embodiment, the rear ramp wall 210 is rearward facing and the front ramp wall 212 is forward facing. The rear ramp wall 210 is oriented at a first angle and the front ramp wall 212 is oriented at a second angle. Angling the ramp walls 210, 212 allows sliding of the latch hook 202 along the receptacle connector 104 during unmating and mating. For example, as the plug connector 102 is mated with the receptacle connector 104, the front ramp wall 212 engages the receptacle housing 110 and slides along the receptacle housing 110 as the plug connector 102 is loaded into the receptacle connector 104. As the front ramp wall 212 slides along the receptacle housing 110, the latch 130 is deflected downward until the latch hook 202 is aligned with and received in the latch opening 118. When mated, the latch hook 202 is coupled to the receptacle housing 110 in the latch opening 118 to secure the plug connector 102 to the receptacle connector 104. For example, the rear ramp wall 210 faces the receptacle housing 110 and restricts unmating of the plug connector 102 from the receptacle connector 104. However, with sufficient rearward pulling force, the latching force of the latch hooks 202 may be overcome and the plug connector 102 may be removed from the receptacle connector 104. For example, as the plug connector 102 is pulled rearward, the rear ramp wall 212 is pulled against the receptacle housing 110. The angle of the rear ramp wall 210 allows deflection of the latch hook 202 in the unlatching direction as the plug connector 102 is pulled rearward. The latch 130 may be released to the unlatched position by other processes, such as pressing downward on the main body 160 to deflect the latch beams 132 to the unlatched positions.

The retention assist member 134 is received in the latch pocket 154 with the latch 130. The retention assist member 134 may be located below the latch 130. The retention assist member 134 is movable relative to the housing 120 in the latch pocket 154. For example, the retention assist member 134 may be slidable forward and rearward between an extended position and a retracted position. In an exemplary embodiment, the retention assist member 134 is movable to the retracted position by pulling the pull tab 136 rearward to release the retention assist member 134 from the latch 130 and allow the latch 130 to move to the unlatched position. When the pull tab 136 is released and the retention assist member 134 is moved to the extended position, the retention assist member 134 presses against the latch 130, such as to hold the latch 130 in the latched position. In an exemplary embodiment, the retention assist member 134 is used to provide assistance to retain the latch 130 in the latched position. For example, the retention assist member 134 provides resistance to unlatching, such as resistance to movement of the latch beams 132 in the downward, unlatching direction. The retention forces provided by the retention assist member 134 need to be overcome by additional rearward pulling force when trying to remove the plug connector 102 from the receptacle connector 104.

The retention assist member 134 includes a main body 300 and rams 302 extending from the main body 300. In an exemplary embodiment, the pull tab 136 extends from the main body 300. The pull tab 136 may be integral with the main body 300. The pull tab 136 may be coupled to the main body 300 in alternative embodiments. The retention assist member 134 includes one or more biasing members 304 extending between the main body 300 and the housing 120. The biasing member 304 forward biases the retention assist member 134 to provide retention assistance for the latch 130. The rams 302 are located behind the latch beams 132 to resist unlatching of the latch beams 132. In an exemplary embodiment, the retention assist member 134 includes two rams 302 located behind the two latch beams 132. Greater or fewer rams 302 may be provided in alternative embodiments.

In an exemplary embodiment, the retention assist member 134 is manufactured from a plastic material. For example, the retention assist member 134 may be a molded part. The rams 302 may be integral with the main body 300, such as being molded with the main body 300. Alternatively, the rams 302 may be separately formed from the main body 300 and coupled thereto, such as being welded, adhered, staked, or fastened to the main body 300. The main body 300 includes a front 312 and a rear 314. The main body 300 includes a first end 316 and a second end 318 opposite the first end 316. The first and second ends 316, 318 extend between the front 312 and the rear 314. In various orientations, the first end 316 may be a top end and the second end 318 may be a bottom end; however, other orientations are possible in alternative embodiments. The main body 300 includes a first side 320 and a second side 322 opposite the first side 320. The first and second sides 320, 322 extend between the front 312 and the rear 314. In the illustrated embodiment, the rams 302 extend forward from the front 312. The rams 302 are located proximate to the first and second sides 320, 322. Other locations are possible in alternative embodiments. In an exemplary embodiment, the main body 300 includes channels 324 that receive the biasing members 304.

The retention assist member 134 includes latch retention supports 330 at distal ends of the rams 302. Each latch retention support 330 is positioned rearward of the corresponding latch beam 132. The latch retention support 330 supports the latch beam 132 in the latched position, such as to resist unlatching. The latch retention support 330 holds the latch beam 132 in the latched position. The forward biasing forces from the biasing members 304 is transferred to the latch retention supports 330 by the rams 302, which press the latch retention supports 330 into the latch beams 132. In an exemplary embodiment, the latch retention support 330 engage the ramps 204 of the latch beams 132 to urge the latch beams 132 forward and upward to the latched positions.

Figure 3:
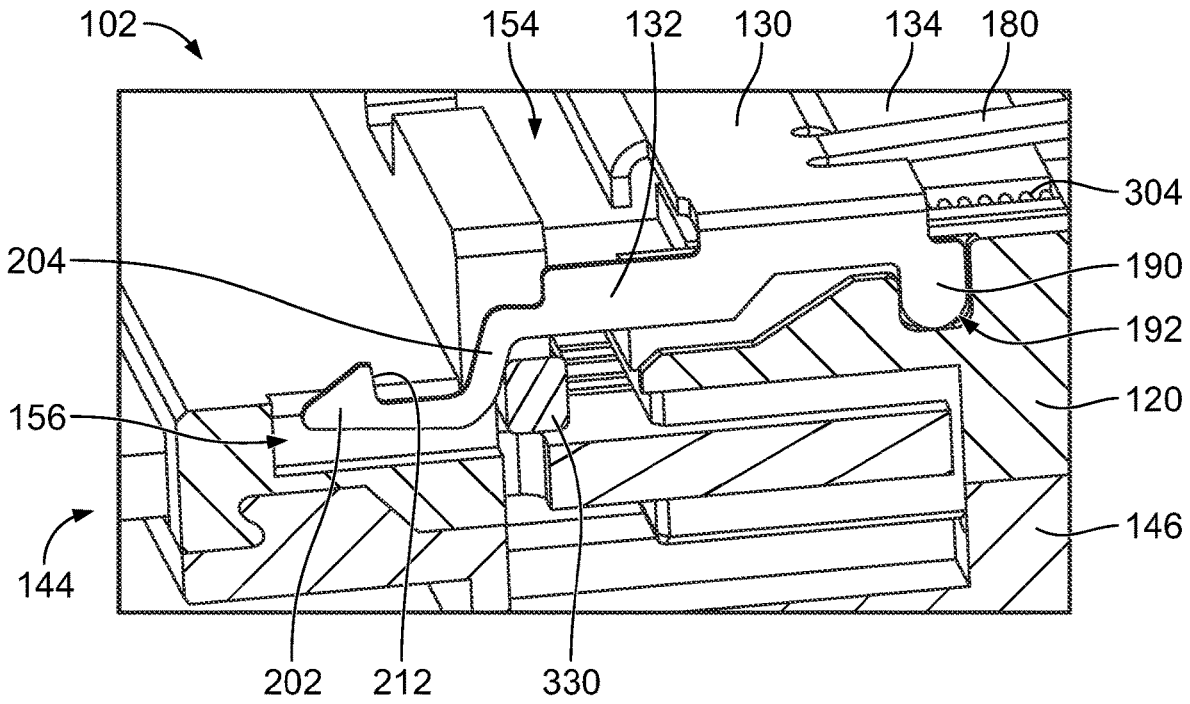
FIG. 3 is a perspective, partial sectional view of a portion of the plug connector in accordance with an exemplary embodiment.
Figure 4:
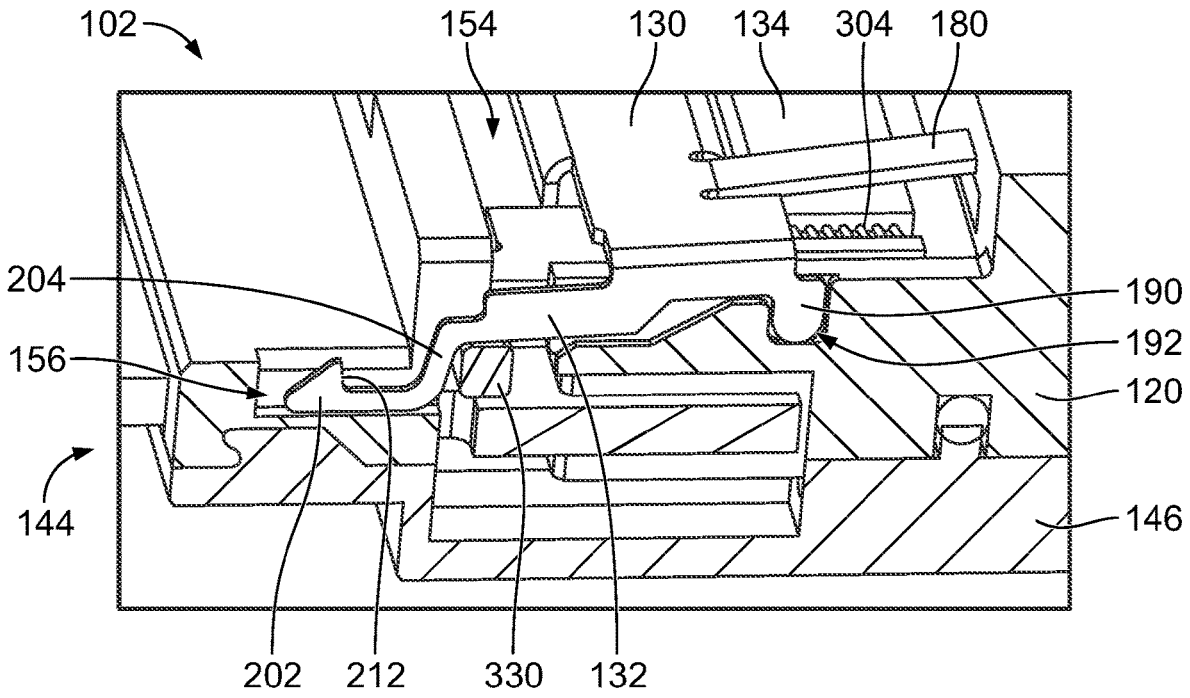
FIG. 4 is a perspective, partial sectional view of a portion of the plug connector in accordance with an exemplary embodiment.

FIG. 3 is a perspective, partial sectional view of a portion of the plug connector 102 in accordance with an exemplary embodiment. FIG. 4 is a perspective, partial sectional view of a portion of the plug connector 102 in accordance with an exemplary embodiment. FIG. 3 illustrates the latch 130 in a latched position. FIG. 4 illustrates the latch 130 in an unlatched position.

The latch 130 and the retention assist member 134 are received in the latch pocket 154. The latch beam 132 extends through the latch channel 156 to the mating end 144 of the housing 110 to interface with the receptacle connector 104 (shown in FIG. 1). The latch channel 156 is sized to accommodate movement of the latch beam 132 in the latch channel 156. The return spring 180 engages the housing 120 in the latch channel 156 and urges the latch 130 to the latched position (FIG. 3). The latch 130 is secured to the housing 120 at the pivot element 190. The pivot element 190 is received in the pocket 192 and the latch 130 is rotatable relative to the housing 120 at the pivot element 190. In an exemplary embodiment, the pivot axis of the latch 130 is generally aligned with the latching surface of the latch hook 202, which reduces the moment or forces needed to rotate and release the latch 130 to the released position.

In the latched position (FIG. 3), the latching features of the latch hooks 202 extend above the first end 146 of the housing 120 for interfacing with the receptacle connector 104. In the released position, the latch hooks 202 are rotated downward into the latch channels 156, such as below the first end 146. The latch hooks 202 may clear the first end 146 to allow the plug connector 102 to be removed from the receptacle connector 104. The return spring 180 holds the latch hooks 202 in the elevated, latched positions. The spring force of the return spring 180 may be overcome by pulling rearward on the plug connector 102, allowing the rear ramp wall 212 to engage and slide along the receptacle connector 104 to force the latch 130 to the unlatched position. In an exemplary embodiment, when the pull tab 136 is pulled rearward, the retention assist member 134 is moved rearward to relieve pressure from the latch beams 132, which reduces the forces needed to unlatch the latch beams 132 from the receptacle connector 104. When the pull tab 136 is released, the biasing members 304 bias the retention assist member 134 forward to the extended position. The latch retention supports 330 press against the ramps 204 of the latch beams 132 to provide retention assistance and increase the forces needed to unlatch the latch beams 132 from the receptacle connector 104.

Figure 5:
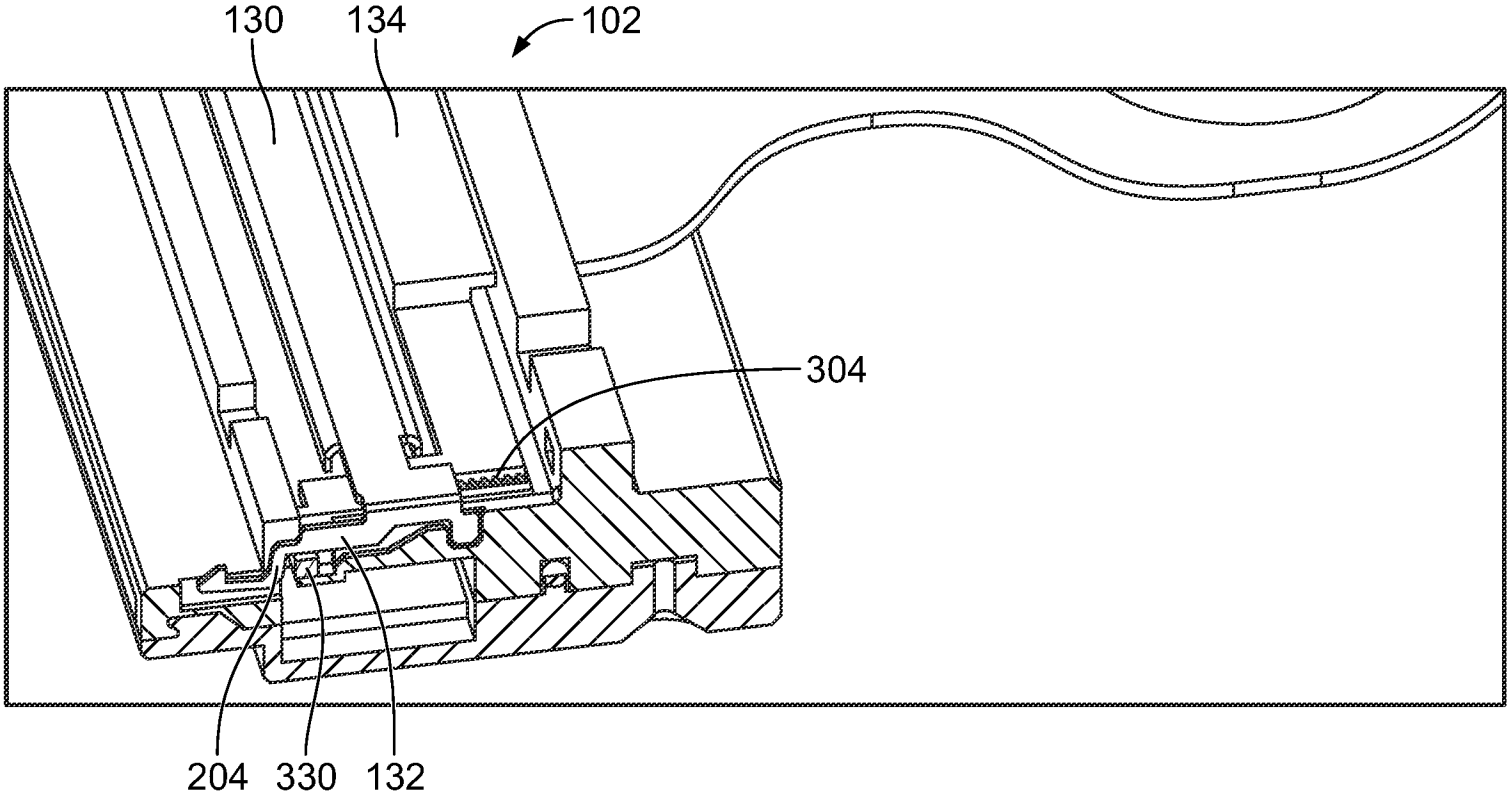
FIG. 5 is a front perspective, partial sectional view of the plug connector in accordance with an exemplary embodiment.

FIG. 5 is a front perspective, partial sectional view of the plug connector 102 in accordance with an exemplary embodiment. The latch 130, in the illustrated embodiment, does not include the return springs 180 (FIG. 2). Rather, the latch 130 is returned to the latched position by the retention assist member 134. For example, the biasing members 304 push the retention assist member 134 forward, which presses the latch retention supports 330 against the ramps 204 of the latch beams 132 to move the latch 130 to the latched position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A plug connector comprising:

a housing having a front and a rear, the housing having a first end and a second end opposite the first end extending between the front and the rear, the housing having a first side and a second side opposite the first side extending between the front and the rear, the housing having a mating end at the front for mating with a mating connector, the housing having a latch pocket at the first end;

plug contacts held by the housing, the plug contacts provided proximate to the mating end for mating with the mating connector;

a latch received in the latch pocket and movable between a latched position and an unlatched position, the latch having a latch main body and a latch beam extending from the main body, the latch beam including a latch hook configured to be received in a latch opening of the mating connector in the latched position to secure the plug connector to the mating connector; and a retention assist member received in the latch pocket and configured to engage the latch, the retention assist member including a main body and a ram extending from the main body, the ram including a latch retention support positioned rearward of the latch beam, the retention assist member including a biasing member engaging the main body of the retention assist member to drive the main body of the retention assist member in a forward biasing direction, the latch retention support being driven into the latch to hold the latch hook in the latching position;

wherein the retention assist member is configured to release from the latch to allow the latch to move from the latched position to the unlatched position to release from the mating connector.

2. The plug connector of claim 1, wherein the retention assist member is slidable relative to the housing between an extended position and a retracted position, the biasing member moving the retention assist member from the retracted position to the extended position, wherein the retention assist member is moved from the extended position to the retracted position to release from the latch and allow the latch to move from the latched position to the unlatched position.

3. The plug connector of claim 1, wherein the biasing member is a coil spring compressible between the retention assist member and the housing.

4. The plug connector of claim 1, wherein the latch retention support presses against the latch beam to force the latch to the latched position.

5. The plug connector of claim 1, wherein the latch beam includes a rail extending from the latch main body and a ramp extending from the rail, the latch retention support engaging the ramp to force the latch to the latched position.

6. The plug connector of claim 5, wherein the ramp is angled transverse to the forward biasing direction.

7. The plug connector of claim 5, wherein the retention assist member is slidable relative to the housing in a horizontal direction, the ramp being angled non-perpendicular to the horizontal direction.

8. The plug connector of claim 1, further comprising a pull tab coupled to the retention assist member, the retention assist member movable to a retracted position when the pull tab is pulled rearward.

9. The plug connector of claim 1, wherein the latch includes a return spring extending between the latch main body of the latch and the housing, the return spring urging the latch to the latched position.

10. The plug connector of claim 1, wherein the latch beam is a first latch beam at a first side of the latch main body of the latch, the latch including a second latch beam at a second side of the latch main body of the latch, the retention assist member located rearward of the second latch beam.

11. The plug connector of claim 10, wherein the latch retention support is a first latch retention support, the retention assist member further comprising a second ram having a second latch retention support, the second latch retention support positioned rearward of the second latch being, the retention assist member further comprising a second biasing member aligned with the second ram.

12. A plug connector comprising:

a housing having a front and a rear, the housing having a first end and a second end opposite the first end extending between the front and the rear, the housing having a first side and a second side opposite the first side extending between the front and the rear, the housing having a mating end at the front for mating with a mating connector, the housing having a latch pocket at the first end;

plug contacts held by the housing, the plug contacts provided proximate to the mating end for mating with the mating connector;

a latch received in the latch pocket and being rotatable between a latched position and an unlatched position, the latch having a latch main body, a first latch beam extending from the latch main body, and a second latch beam extending from the latch main body, the first latch beam including a first latch hook configured to be received in a latch opening of the mating connector in the latched position to secure the plug connector to the mating connector, the second latch beam including a second latch hook configured to be received in a latch opening of the mating connector in the latched position to secure the plug connector to the mating connector; and a retention assist member received in the latch pocket and configured to engage the latch, the retention assist member including a main body, a first ram extending from the main body, and a second ram extending from the main body, the first ram including a first latch retention support positioned rearward of the first latch beam, the second ram including a second latch retention support positioned rearward of the second latch beam, the retention assist member slidable relative to the housing between an extended position and a retracted position, the retention assist member including a biasing member engaging the main body of the retention assist member to drive the main body of the retention assist member in a forward biasing direction to the extended position;

wherein the latch is configured to move to the unlatched position when the retention assist member is in the retracted position, the latch retention support being driven into the latch to move the latch to the latched position when the retention assist member is moved to the extended position.

13. The plug connector of claim 12, wherein the first latch retention support presses against the first latch beam to force the latch to the latched position.

14. The plug connector of claim 12, wherein the first latch beam includes a rail extending from the latch main body and a ramp extending from the rail, the first latch retention support engaging the ramp to force the latch to the latched position, the ramp being angled transverse to the first latch retention support.

15. The plug connector of claim 12, further comprising a pull tab coupled to the retention assist member, the retention assist member movable to the retracted position when the pull tab is pulled rearward, wherein the retention assist member is moved from the extended position to the retracted position to release from the latch and allow the latch to move from the latched position to the unlatched position.

16. The plug connector of claim 12, wherein the latch includes a return spring extending between the latch main body of the latch and the housing, the return spring urging the latch to the latched position.

17. The plug connector of claim 12, wherein the first latch beam is at a first side of the latch main body of the latch, the second latch beam is at a second side of the latch main body of the latch, the retention assist member further comprising a second biasing member aligned with the second ram.

18. A plug connector comprising:

a housing having a front and a rear, the housing having a first end and a second end opposite the first end extending between the front and the rear, the housing having a first side and a second side opposite the first side extending between the front and the rear, the housing having a mating end at the front for mating with a mating connector, the housing having a latch pocket at the first end;

plug contacts held by the housing, the plug contacts provided proximate to the mating end for mating with the mating connector;

a latch received in the latch pocket and movable between a latched position and an unlatched position, the latch having a latch main body and a latch beam extending from the latch main body, the latch beam including a rail at a proximal end extending from the latch main body, the latch beam including a ramp extending from the rail, the latch beam including a latch hook at a distal end configured to be received in a latch opening of the mating connector in the latched position to secure the plug connector to the mating connector; and a retention assist member received in the latch pocket and configured to engage the latch, the retention assist member including a main body and a ram extending from the main body, the ram including a latch retention support positioned rearward of the latch beam, the retention assist member including a biasing member engaging the main body of the retention assist member to drive the main body of the retention assist member in a forward biasing direction, the latch retention support engaging the ramp of the latch beam to drive the latch to the latching position;

wherein the retention assist member is configured to release from the latch to allow the latch to move from the latched position to the unlatched position to release from the mating connector.

19. The plug connector of claim 18, wherein the ramp is angled transverse to the latch retention support.

20. The plug connector of claim 18, further comprising a pull tab coupled to the retention assist member, the retention assist member movable to the retracted position when the pull tab is pulled rearward.

* * * * *